US005850589A

United States Patent [19]

Cruz et al.

[11] Patent Number: 5,850,589

[45] Date of Patent: Dec. 15, 1998

[54] SHEET MOISTURE REPLACEMENT SYSTEM USING WATER JET TECHNOLOGY

[75] Inventors: Randolph Cruz, Palm Bay, Fla.; Thomas Acquaviva, Penfield, N.Y.

[73] Assignee: Xerox Corporation, Stamford, Conn.

[21] Appl. No.: 939,895

[22] Filed: Sep. 29, 1997

[51] Int. Cl.[6] ..... G03G 15/20; G03G 15/00

[52] U.S. Cl. ..... 399/341; 399/67; 399/390; 399/406

[58] Field of Search ..... 399/341, 342, 399/406, 390, 67, 322

[56] References Cited

U.S. PATENT DOCUMENTS

| | | | |
|---|---|---|---|
| 5,264,899 | 11/1993 | Mandel | 355/200 |
| 5,434,029 | 7/1995 | Moser | 430/97 |
| 5,515,152 | 5/1996 | Kuo | 399/406 |
| 5,548,389 | 8/1996 | Bowler, Jr. | 399/406 |
| 5,555,083 | 9/1996 | Kuo et al. | 399/406 |
| 5,579,693 | 12/1996 | Carreira et al. | 101/424.1 |
| 5,717,836 | 2/1998 | Horie | 399/406 |
| 5,761,600 | 6/1998 | Murata | 399/406 |

*Primary Examiner*—R. L. Moses
*Assistant Examiner*—Shival Virmani
*Attorney, Agent, or Firm*—William A. Henry, II

[57] ABSTRACT

A device for adding controlled amounts of moisture to one or both sides of a copy sheet. The device includes a pair of water jets, a reservoir for storing a quantity of liquid and connected to the water jet, a pair of generally cylindrical, pressure rolls, each having an outer cylindrical surface with the rolls being aligned with respect to one another along their axes so as to define a nip between the outer cylindrical surfaces, and a controller for controlling application of water from the water jets to selected portions of each sheet passing thereunder before each sheet enters the nip formed between the outer cylindrical surfaces. Alternatively, the water jets could apply the liquid to the cylindrical surfaces of the pressure rolls.

18 Claims, 5 Drawing Sheets

FIG. 4
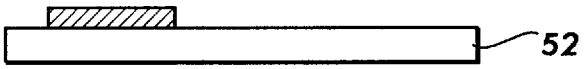
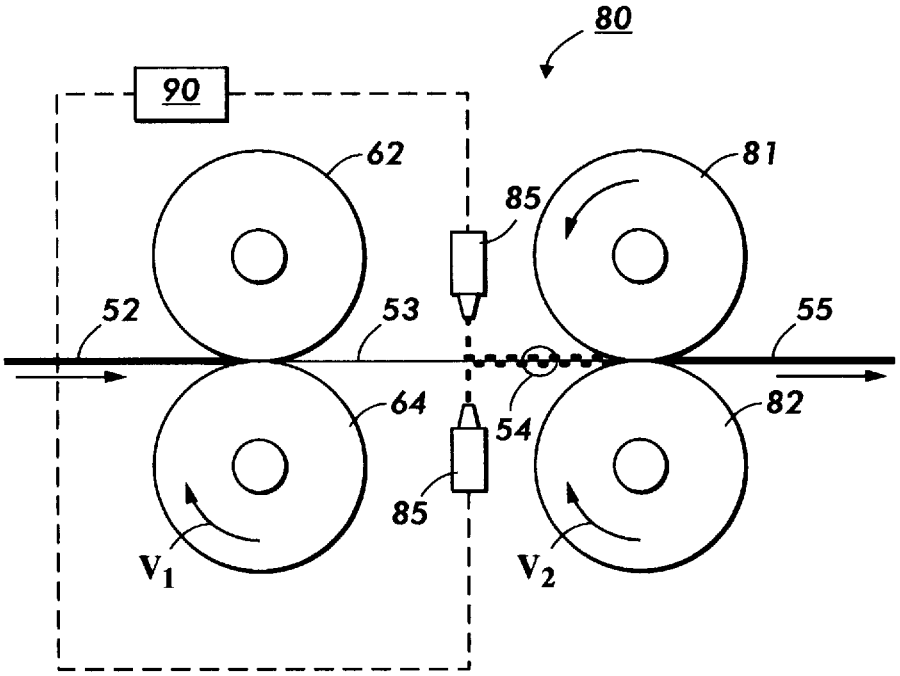
FIG. 5

SHEET MOISTURE REPLACEMENT SYSTEM USING WATER JET TECHNOLOGY

BACKGROUND OF THE INVENTION

1. Field of the Invention

This invention relates generally to a substrate conditioning device for an electrophotographic printing machine and, more particularly, concerns a device to apply moisture to cut sheets or web fed material in a full color process printing machine.

2. Description of the Prior Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling. One solution to this problem is set forth in U.S. Pat. No. 5,434,029 ; the contents of which are hereby incorporated by reference.

A second problem associated with moisture loss in paper is paper waviness. As sheets pass through the fixing system, moisture is driven out and the sheet temperature is elevated. If after fixing, the sheet is then allowed to rest in a collection area fully exposed to its ambient surroundings, its moisture content will equilibrate with the environment through absorption of moisture across the full face of at least one side of the paper sheet. If, however, the copy sheet becomes part of a large compiled set, both sides of all of the papers in the compilation (except for the top sheet) will effectively be sealed off from the moisture within the atmosphere. The only route available to this desiccated paper for moisture reabsorption is through the edges of the sheets, leaving the moisture content of the central portions of the sheets relatively unchanged. This uneven pattern of moisture reabsorption results in edge stresses that lead to paper waviness along the edges of the paper. The resulting wave pattern may typically have an amplitude of ⅛ inch to ¼ inch.

In addition to being cosmetically unsightly, the edge wave creates a secondary handling problem, in that pages having such a wave pattern along their edges are more difficult to feed to secondary paper handling machines, such as a binder apparatus. For this reason, printers continue to favor the use of offset presses for large compilations.

Paper curl is defined as any deviation from it's flat state. In the xerographic process, fusing drives moisture out. When regaining moisture, paper experiences curl due to differential hygroexpansitivity between the paper and toner. The paper expands due to moisture reabsorption, but the toner does not expand, thus developing curl. Paper curl is one of the primary causes for paper handling problems in copying machines. Problems, such as, stubbing, image deletions and improper stacking resulting from copy sheet curl. These problems are more severe for color copies than black and white due to differences in their toner mass area, substrates, and fuser characteristics.

Among the factors identified as affecting curl, two are most critical: namely, dynamic change in moisture content causing a moisture gradient throughout the paper thickness; and simultaneous bending stress and moisture change. An object in counteracting curl is to re-moisturize the sheet to its steady state condition. However, if there is a high concentration of toner on a sheet 52 as shown in FIG. 1, uniform curl may occur in about 30 minutes after fusing as shown in FIG. 1A. With a non-uniform image across a sheet as shown in FIG. 2, non uniform curl, as well as, cockle or diagonal curl may occur about 30 minutes after fusing as depicted in FIG. 2A. Diagonal curl or cockle has not been addressed and corrected by conventional mechanical or smart decurlers due to the fact that they treat the sheet for uniform curl and apply uniform amounts of water or uniform bending across one or both sheet surfaces. Also, other proposed sheet moisturizers, as shown for example, in U.S. Pat. Nos. 5,264,899 and 5,434,029, apply uniform amounts of water across the sheet surface. Thus, there is a need to apply higher amounts of water in the heavily toned area than in the non-image area to end up with an equilibrated sheet 52 (FIGS. 3 and 4).

There remains a need for a system for preventing curl and edge waviness caused by the loss of moisture from the copy sheet during the fixing step of electrostatographic reproduction or printing that is practical for use with electrostatographic machines.

The following disclosures may be relevant to various aspects of the present invention:

| |
|---|
| U.S. Pat No. 5,264,899<br>Patentee: Mandel<br>Issued: Nov. 23, 1993<br>U.S. Pat. No. 5,434,029<br>Inventor: Moser<br>Issue Date: Jul. 18, 1995<br>U.S. Pat No. 5,579,693<br>Inventor: Carreira et al.<br>Issue Date: Dec. 3, 1996 |

Portions of the foregoing disclosures may be briefly summarized as follows:

U.S. Pat. No. 5,264,899 describes a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the copy sheet as it is passed through the nip. The added moisture prevents edge wave formation.

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aftermentioned nip.

U.S. Pat. No. 5,579,693 is directed to a method and apparatus for controlling curl in a liquid ink printer. The liquid ink printer deposits an anticurl material on the side of a printed sheet opposite the one having printing deposited thereon. The anticurl fluid can be deposited by a spray device or a thermal ink jet printhead ejecting anticurl fluid or deposited with a roller made of a foam material for absorbing the anticurl fluid or a roller having dimples disposed on the surface thereof.

SUMMARY OF THE INVENTION

In accordance with one aspect of the present invention, there is provided a device for adding controlled amounts of moisture to one or both sides of a copy sheet. The device comprising a water jet, a reservoir for storing a quantity of liquid and connected to said water jet, a pair of generally cylindrical, pressure rolls, each having an outer cylindrical surface, said rolls being aligned with respect to one another along their axes so as to define a nip between said outer cylindrical surfaces, and a controller for controlling application of water from said water jet to selected portions of each sheet passing thereunder before each sheet enters said nip formed between said outer cylindrical surfaces.

In accordance with another aspect of the invention there is provided a system for fixing a toner image to a copy sheet in an electrophotographic system so as to avoid the formation of copy sheet curl. The system comprising first and second fusing rollers defining a nip therebetween, at least one of said fusing rollers being heated, wherein the fusing rollers serve to fix a toner image on a copy sheet through the application of heat and pressure to the copy sheet; a device to transport a copy sheet from said fusing rollers to a sheet conditioning system, comprising; a water jet, a pair of generally cylindrical, pressure rolls, each having an outer cylindrical surface, said rolls being aligned with respect to one another along their axes so as to define a nip between said outer cylindrical surfaces, and control means for actuating said water jet to apply water to selected portions of a sheet before it enters said nip.

In accordance with yet another aspect of the invention there is provided a method for replenishing the moisture that a copy sheet looses as it is heated in an electrophotographic machine of the type having a thermal fuser. The method comprising the steps of transporting liquid from a water jet directly to selected portions of a copy sheet after it has left a fuser or from the water jet to one of a pair of rolls that are arranged so as to form a nip therebetween, transporting the copy sheet from the fuser through the nip of the rolls, and transferring liquid from said one roll to selected areas of said copy sheet.

BRIEF DESCRIPTION OF THE DRAWINGS

Other features of the present invention will become apparent as the following description proceeds and upon reference to the drawings, in which:

FIG. 4 is a side view of the copy sheet in FIG. 2;

FIG. 5 is an enlarged, partial side view of the paper conditioning device of the present invention;

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 7:
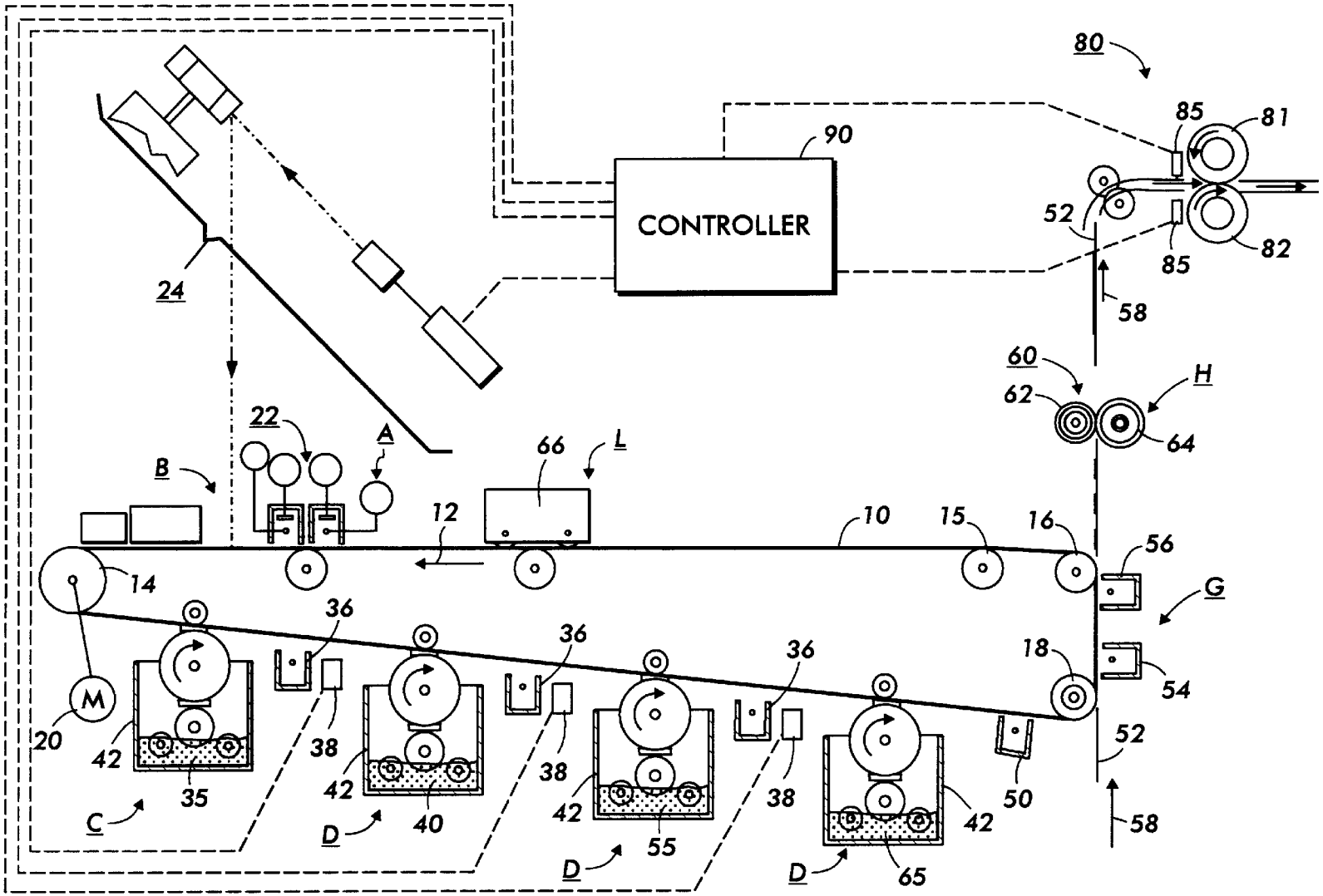
FIG. 7 is a schematic elevational view of a full color image-on-image single pass electrophotographic printing machine utilizing the paper conditioning device described herein.

Turning now in general to FIG. 7, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension roller 16 and fixed roller 18 and the roller 14 is operatively connected to a drive motor 20 for effecting movement of the belt through the xerographic stations.

With continued reference to FIG. 7, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud 20 causes charged toner particles to be attracted to the electrostatic latent image. Appropriate developer biasing is accomplished via a power supply. This type of system is a non-contact type in which only toner particles 35 (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager for a third suitable color toner 55, such as, magenta and for a fourth imager and suitable color toner 65, such as, cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to sheet moisture replacement system 80 and then to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

As shown in FIG. 5, the sheet moisture replacement system in accordance with one aspect of the present invention, generally referred to as reference numeral 80, accepts sheets that have passed through a fusing nip 62, 64 and uses water jets 85 to apply a liquid, which in this instance is water, directly onto one or both sides of sheet 52. The sheet 52 is stretched taut between fusing nip 62, 64 and pressure rollers 81 and 82 due to fuser nip roll 64 rotating at a predetermined speed of $V_1$ and roll 82 rotating at a different predetermined speed of $V_2$, and has a moisture loss as indicated at 53 before moisture is added back into the sheet at 54 by water jets 85. Water has been added to the sheet to bring it back to equilibrium at 55. Water jets 85 are controlled by controller 90 which through conventional software determines the toner density in different areas of the sheet. As a result, water jets 85 will apply a more accurate amount of water to the different areas of the sheet depending on the toner density throughout the sheet, i.e., higher amounts of moisture is applied under the heavily toned areas than under the non-imaged areas to end up with an equilibrated sheet and, thus reducing the chances of non-uniform curl, diagonal curl or cockle appearing in the sheet. It should be understood that only one of the water jets could be used in accordance with the present invention, if desired. The one water jet could apply water to selected areas of the top or bottom surface of a sheet.

Figure 1:
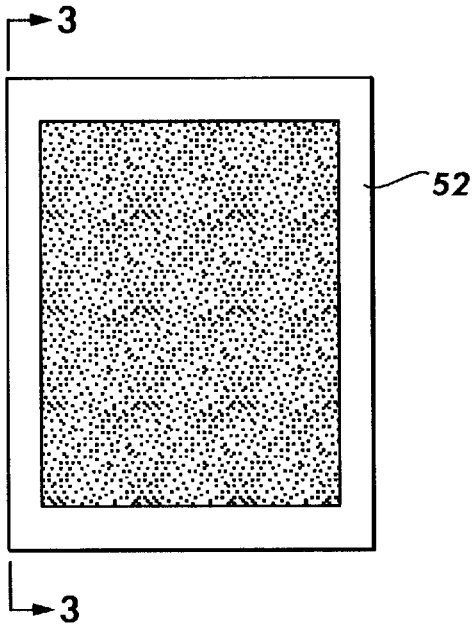
FIG. 1 is a top view of a copy sheet with a toned image thereon that covers a major portion of the copy sheet.
Figure 1A:
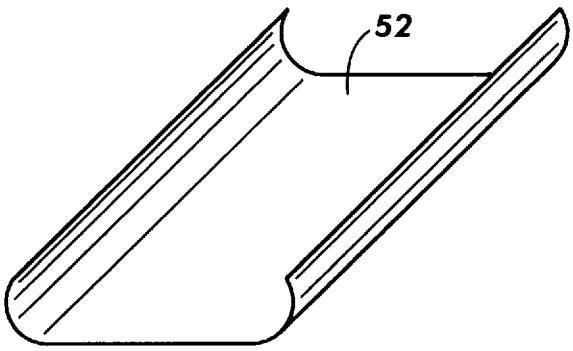
FIG. 1A is an isometric view of the sheet of FIG. 1 with uniform curl therein.
Figure 2:
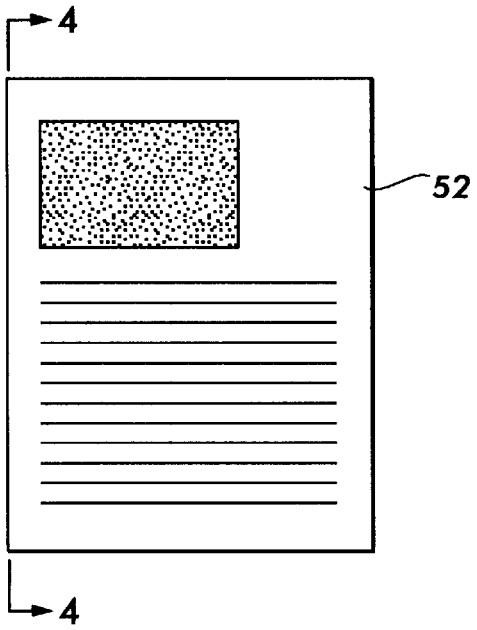
FIG. 2 is a top view of a copy sheet with a toned image on a small portion of the copy sheet;.
Figure 2A:
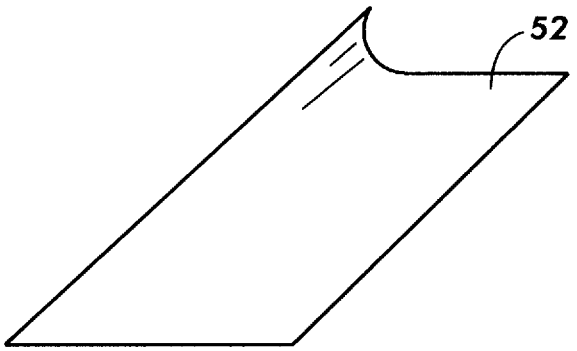
FIG. 2A is an isometric view of the sheet of FIG. 2 with diagonal curl therein.
Figure 3:
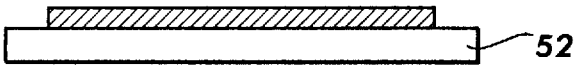
FIG. 3 is a side view of the copy sheet in FIG. 1.
Figure 6:
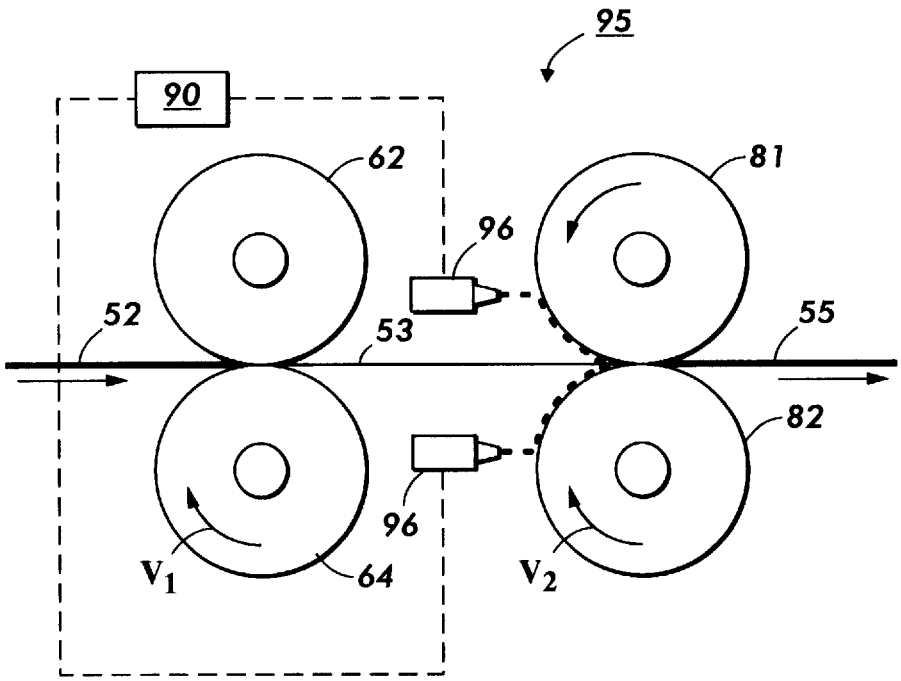
FIG. 6 is an enlarged, partial side view of an alternative embodiment of a paper conditioning device in accordance with the present invention.

An alternative sheet moisture replacement system 95 for preventing non-uniform curl, diagonal curl and cockle in sheets that are being fused is shown in FIG. 6 which employs the same mechanisms as used in system 80 of FIG. 5, except a water jets 96 are positioned to apply a liquid, which in this case is water, directly onto pressure rolls 81 and 82 that mateto form a nip through which sheet 52 passes after having been fused at the fuser nip formed by fuser rolls 62, 64. Water on pressure rolls 81 and 82 is pressed into sheet 52 to replace moisture lost when the sheet passed through the fuser. By applying water directly to pressure rolls 81 and 82, the need for metering rollers which have a low life expectancy due to contamination, high pressures and high temperatures of the fusing area is eliminated.

In recapitulation, there is provided a paper conditioner to control image dependent curl which uses a water jet to apply water to fused images to account for different moisture requirements. Variable output of moisture is supplied to the a sheet to prevent diagonal curl and cockle, as well as, uniform curl. The term water jet is intended to encompass spraying devices, as well as, ink jet printheads.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A device for adding moisture to a copy sheet, comprising:

a pair of water jets including a quantity of liquid, and wherein one each of said water jets is placed on opposite sides of the copy sheet;

a pair of generally cylindrical rolls, each having an outer cylindrical surface, said rolls being aligned with respect to one another along their axes so as to define a nip between said outer cylindrical surfaces, and wherein said water jets are positioned to apply liquid to both sides of a sheet prior to the sheet entering said nip; and a controller for generating signals and controlling the flow of fluid to selected areas of the sheet from said water jets in accordance with said signals.

2. The device according to claim 1, wherein said roll pair comprises;

a first roll having an elastomeric coating to drive a sheet in a first direction through the nip; and a second roll, for pressing liquid into a side of the sheet opposite the side that contacts said first roll, said second roll having a smooth outer cylindrical surface, and wherein said second roll rotates in a direction opposite the direction of said first roll.

3. The device according to claim 2, wherein said water jets each include a reservoir.

4. The device according to claim 2, wherein said water jets apply a higher amount of liquid in imaged areas than in non-imaged areas of the sheet.

5. The device according to claim 4, wherein said liquid is water.

6. The device according to claim 1, wherein said water jets supply a variable output of moisture to each sheet passing thereunder.

7. The device according to claim 6, wherein said water jets variable output of moisture to each sheet passing thereunder is dependent on toner density across each sheet.

8. An apparatus according to claim 7, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

9. A system for fixing a toner image to a copy sheet in an electrophotographic system so as to avoid the formation of a wave along the edge of the copy sheet and a curl in the body of the sheet, comprising:

first and second fusing rollers defining a nip therebetween, at least one of said fusing rollers being heated, and wherein the fusing rollers serve to fix a toner image on a copy sheet through the application of heat and pressure to the copy sheet;

a device to transport a copy sheet from said fusing rollers to a sheet conditioning system, comprising;

at least one water jet positioned on opposite sides of the copy sheet with each of said at least one water jet being connected to a quantity of liquid;

a pair of generally cylindrical rolls, each having an outer cylindrical surface, said rolls being aligned with respect to one another along their axes so as to define a nip between said outer cylindrical surfaces; and a control device for determining the location and density of toned images on the copy sheet and providing signals indicative thereof to actuate said water jets in accordance with said signals.

10. A system according to claim 9, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

11. The system according to claim 9, wherein said fluid is water.

12. The system according to claim 9, wherein said controller actuates each of said water jets to apply different amounts of water across the sheet depending of the toner density across the sheet.

13. A device for replenishing the moisture that a copy sheet loses as it is heated in an electrophotographic machine of the type having a thermal fuser, comprising:

a water jet on both sides of the copy sheet;

a source of liquid connected to each of said water jets;

a pair of transfer rolls arranged to form a nip therebetween through which the copy sheet is conveyed;

a controller for determining toner density on the copy sheet and generating toner density signals to actuate said water jets to apply liquid to each of said transfer rolls in accordance with said toner density signals.

14. A method for replenishing the moisture that a copy sheet loses as it is heated in an electrophotographic machine of the type having a thermal fuser, comprising the steps of:

providing a water jet on both sides of the copy sheet;

providing a controller for determining toner density on the copy sheet and generating density signals to actuate said water jets in accordance with said signals;

supplying water from said water jets to each one of a pair of rolls that are arranged so as to form a nip therebetween;

transporting the copy sheet from the fuser through the nip of the rolls;

transferring water from each of said pair of rolls to said copy sheet.

15. A method for adding moisture to a copy sheet, comprising the steps:

providing a pair of water jets including a quantity of liquid for each water jet;

supplying a pair of generally cylindrical rolls, each having an outer cylindrical surface, said rolls being aligned with respect to one another along their axes so as to define a nip between said outer cylindrical surfaces, and wherein one each of said pair of water jets is positioned to apply liquid to a both sides of a sheet prior to the sheet entering said nip;

using a controller to provide signals indicative of imaged areas of the sheet; and actuating said pair of water jets in accordance with said signals and controlling the flow of fluid to the sheet from said water jets in accordance with said signals.

16. A device for adding controlled amounts of moisture to a copy sheet, comprising:

a water jet;

a reservoir for storing a quantity of liquid and connected to said water jet;

a pair of generally cylindrical, pressure rolls, each having an outer cylindrical surface, said rolls being aligned with respect to one another along their axes so as to define a nip between said outer cylindrical surfaces; and a controller for controlling application of liquid from said water jet to selected portions of each sheet passing thereunder before each sheet enters said nip formed between said outer cylindrical surfaces.

17. A system for fixing a toner image to a copy sheet in an electrophotographic system so as to avoid the formation of copy sheet curl, comprising:

first and second fusing rollers defining a nip therebetween, at least one of said fusing rollers being heated, wherein the fusing rollers serve to fix a toner image on a copy sheet through the application of heat and pressure to the copy sheet; and A sheet conditioning system that receives a sheet after it exits said fusing rollers, said sheet conditioning system comprising; a water jet, a pair of generally cylindrical, pressure rolls, each having an outer cylindrical surface, said rolls being aligned with respect to one another along their axes so as to define a nip between said outer cylindrical surfaces, and control means for actuating said water jet to apply water to selected portions of one of said rolls before the sheet enters said nip.

18. A method for replenishing the moisture that a copy sheet loses as it is heated in an electrophotographic machine of the type having a thermal fuser, comprising the steps of:

Transporting the copy sheet through said fuser;

receiving the copy sheet within a pair of rolls that are arranged so as to form a nip therebetween;

providing a water jet and transporting liquid from said water jet directly to selected portions of the copy sheet before it enters said nip.

* * * * *